US006478326B1

(12) United States Patent
Lee

(10) Patent No.: US 6,478,326 B1
(45) Date of Patent: Nov. 12, 2002

(54) PUSHCART WITH LEG POSITION CONTROL GEAR

(75) Inventor: Daniel Lee, Taipei Hsien (TW)

(73) Assignee: Shanghai Apex HME Industry Co., Ltd., Shanghai (TW)

( * ) Notice: Subject to any disclaimer, the term of this patent is extended or adjusted under 35 U.S.C. 154(b) by 0 days.

(21) Appl. No.: 09/907,665

(22) Filed: Jul. 19, 2001

(51) Int. Cl.[7] ..... A61H 3/04
(52) U.S. Cl. ..... 280/639; 135/67
(58) Field of Search ..... 280/639, 642, 280/647, 87.021, 87.041, 87.05; 135/66, 67, 74, 76, 85; 297/5, 188.12; 482/66, 67, 68

(56) References Cited

U.S. PATENT DOCUMENTS 2,685,325 A * 8/1954 Webster ..... 155/30
4,341,381 A * 7/1982 Norberg ..... 272/70.4
5,348,336 A * 9/1994 Fernie et al. ..... 280/641
5,409,028 A * 4/1995 Lee ..... 135/66
5,816,593 A * 10/1998 Che ..... 280/87.041
5,887,887 A * 3/1999 Keuning ..... 280/641
6,318,392 B1 * 11/2001 Chen ..... 135/67

FOREIGN PATENT DOCUMENTS

TW 88209563 6/1999

* cited by examiner

*Primary Examiner*—Kevin Hurley
*Assistant Examiner*—Tony Winner
(74) *Attorney, Agent, or Firm*—Rabin & Berdo, P.C.

(57) ABSTRACT

A pushcart includes two front braces and a rear support having a cross bar and two legs. Two ends of the cross bar are movably received in a locating brace and a locking part of a leg position control gear fixedly mounted to rear sides of the two front braces. A push part of the gear is movably connected to a rear side of the locking part. When the cross bar is moved to a lower end of the locking part to move the two legs to an extended position, a lever mounted in the locking part is pushed by an elastic element mounted on the push part to press against the cross bar and thereby prevent the extended legs from moving. When the push part is pushed upward, the lever is moved away from the cross bar, allowing the legs to move toward the front braces into a collapsed position.

12 Claims, 7 Drawing Sheets

PUSHCART WITH LEG POSITION CONTROL GEAR

FIELD OF THE INVENTION

The present invention relates to a pushcart, and more particularly to a pushcart having a leg position control gear. The leg position control gear includes a locking part and a push part. When two rear legs of the pushcart are in an extended position for use, the legs are locked by the locking part from moving; and when the push part is moved upward, the legs are released from the locking part and could be moved to a collapsed position for convenient storage.

BACKGROUND OF THE INVENTION

A pushcart having collapsible legs is particularly suitable for use as a medical aid.

FIGS. 1 and 2 show a conventional pushcart with collapsible legs disclosed in Taiwanese Patent Application No. 88209563 entitled "Assisting Pushcart". The pushcart 10 includes a front frame 20 and a rear support 30. The rear support 30 may be moved between an extended position and a collapsed position relative to the front frame 20 through a stop member 40 and a safety lock 50. By inward pushing a control end 512 of a locking part 51 of the safety lock 50, an elastic element 521 is compressed and a lower end surface 511 of the locking part 51 is temporarily moved away from an open space 41 defined by the stop member 40. At this point, a cross bar 33 of the rear support 30 is allowed to move up and down in the open space 41. When the cross bar 33 is moved to a desired position in the open space 41, the control end 512 is released and the elastic element 521 brings the lower end surface 511 of the locking part 51 to press against the cross bar 33, preventing the same from moving in the open space 41 and holding the rear support 30 to the extended position. The assisting pushcart 10 with the rear support 30 in the extended position helps an invalid, an aged or a patient to move safely.

There are drawbacks existing in the above-described conventional pushcart. Generally, the elastic element 521 must have a considerably strong elasticity for it to have sufficient restoring force when a compressive source is removed, so that the lower end surface 511 of the safety lock 50 could effectively press against and lock the cross bar 33 in place. That is, the elastic element 521 must have a high coefficient of elasticity. In the event the elastic element 521 has not sufficient elasticity and fails to effectively press against and hold the cross bar 33 in place, the safety lock 50 would disengage from the stop member 40 and result in danger and injury to a user. However, when the elastic element 521 has a strong elasticity, the user would have to exert a big force to push and hold the control end 512 of the safety lock 50 to keep the lower end surface 511 disengaged from the cross bar 33 in order to move the rear support 30 into the collapsed position. This design causes inconvenience to users and is not suitable for the invalid, the aged or the patient who usually has difficulty in exerting a big force to hold the control end 512 to a depressed position.

Moreover, the safety lock 50 is caused to disengage from the cross bar 33 by pushing the control end 512 toward the stop member 40. The control end 512 is very easily subjected to a force in a direction toward the stop member 40 due to unexpected collision and undesirably unlocks the cross bar 33, resulting in unwanted collapse of the rear support 30 and accordingly dangers to the user.

Another problem with the above-described conventional pushcart is there are gaps existing between two wing portions 43, 44 of the stop member 40 and an outer wall of the locking part 51. When the locking part 51 is moved toward or away from the stop member 40 during the operation of extending or collapsing the rear support 30, such gaps tend to pinch the user's finger or even the user's loose clothes and cause dangers to the user.

SUMMARY OF THE INVENTION

A primary object of the present invention is to provide a pushcart with a leg position control gear that enables a user to apply only a minor upward force at a push part of the leg position control gear to easily move a rear support of the pushcart into a collapsed position for convenient storage, and to directly pull the rear support away from a front frame of the pushcart to move into an extended position without exerting any force at the push part.

Another object of the present invention is to provide a pushcart with a leg position control gear that includes a U-shaped push part to enclose a locking part of the leg position control gear, so that a user would not be pinched by any gap between the locking part and the push part while extending or collapsing the legs of the pushcart.

A further object of the present invention is to provide a pushcart with a leg position control gear that requires an upward force to move a push part of the leg position control gear to unlock two legs of the pushcart, so that the legs are not easily unlocked to collapse by a forward force applied on the push part due to unexpected collision or touch of the push part.

A still further object of the present invention is to provide a pushcart with a leg position control gear that includes a push part to elastically push a lever to lock legs of the pushcart in place or to release the legs. The whole leg position control gear has simple structure and can be easily assembled to enable reduced manufacturing cost of the pushcart.

To achieve the above and other objects, the pushcart of the present invention is characterized in a leg position control gear that includes a locking part fixedly mounted to a predetermined position at a rear side of a front brace of the pushcart, so that an open space is defined between the locking part and the front brace for a cross bar of a rear support of the pushcart to up and down movably locate therein; a lever pivotally mounted in a through hole on the locking part, so that a lower arm thereof could be turned forward into the open space to press against the cross bar located in the open space; and a push part up and down movably connected to a rear side of the locking part, so that an elastic element mounted to an inner side of the push part normally contacts with and pushes the lower arm of the lever forward.

When the rear support is in a collapsed position closed to the front brace of the pushcart, the cross bar is located at an upper portion of the open space. When the cross bar is moved downward in the open space, the lower arm of the lever is pushed rearward by the cross bar to compress the elastic element, allowing the cross bar to move to a lower portion of the open space and the rear support to move rearward to an extended position. At this point, the lower arm of the lever is pushed forward again by the elastic element to firmly press a lower end against the cross bar and thereby lock the rear support in the extended position without moving.

When rear support is in the extended position and the push part of the leg position control gear is lightly pushed upward, the push part turns the lever to disengage the lower arm of the lever from the cross bar, allowing the cross bar to move upward in the open space and pull the whole rear support toward the front brace into the collapsed position.

The leg position control gear for the pushcart of the present invention ensures safe locking of the rear support of the pushcart to the extended position for use. A user needs only to push of the cross bar downward to move the rear support rearward to the extended position, or to upward push the push part to allow the rear support to move into the collapsed position. The pushcart of the present invention is therefore simple and safe for use.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
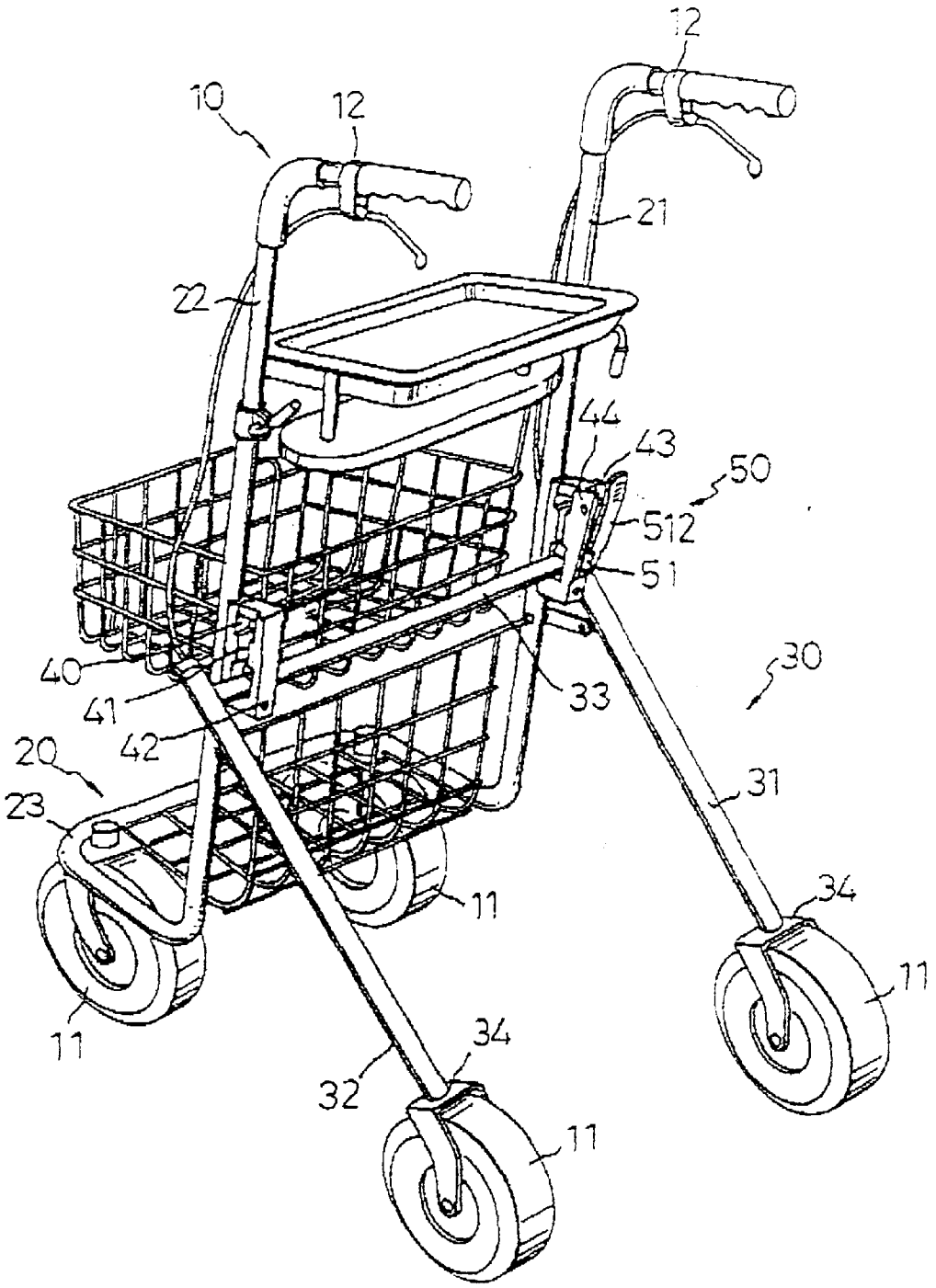
FIG.1 (Prior Art)
FIG. 1 is a rear perspective view of a conventional pushcart with collapsible legs.
Figure 2:
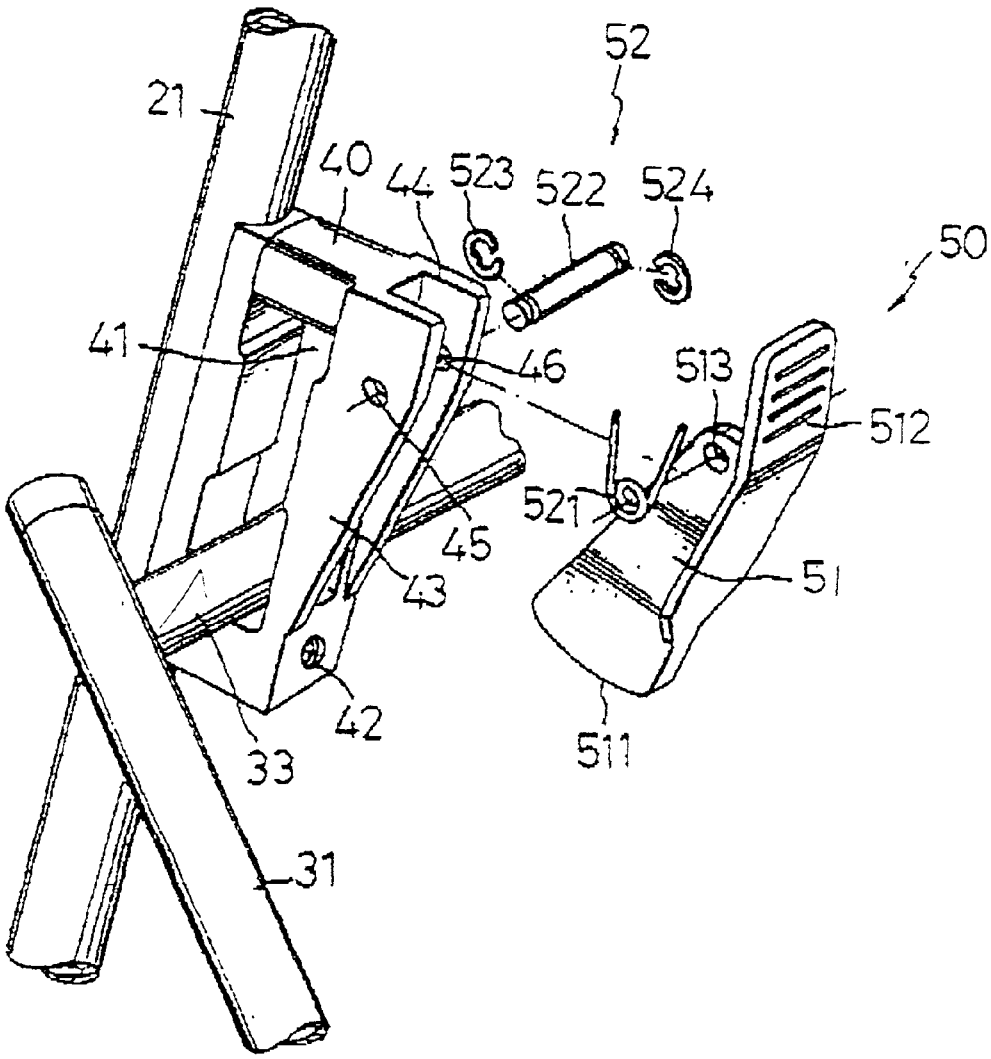
FIG.2 (Prior Art)
FIG. 2 is an enlarged and exploded perspective view of a safety lock for the pushcart of FIG. 1 to lock the collapsible legs of the pushcart to an extended position for use or a collapsed position for storage.
Figure 3:
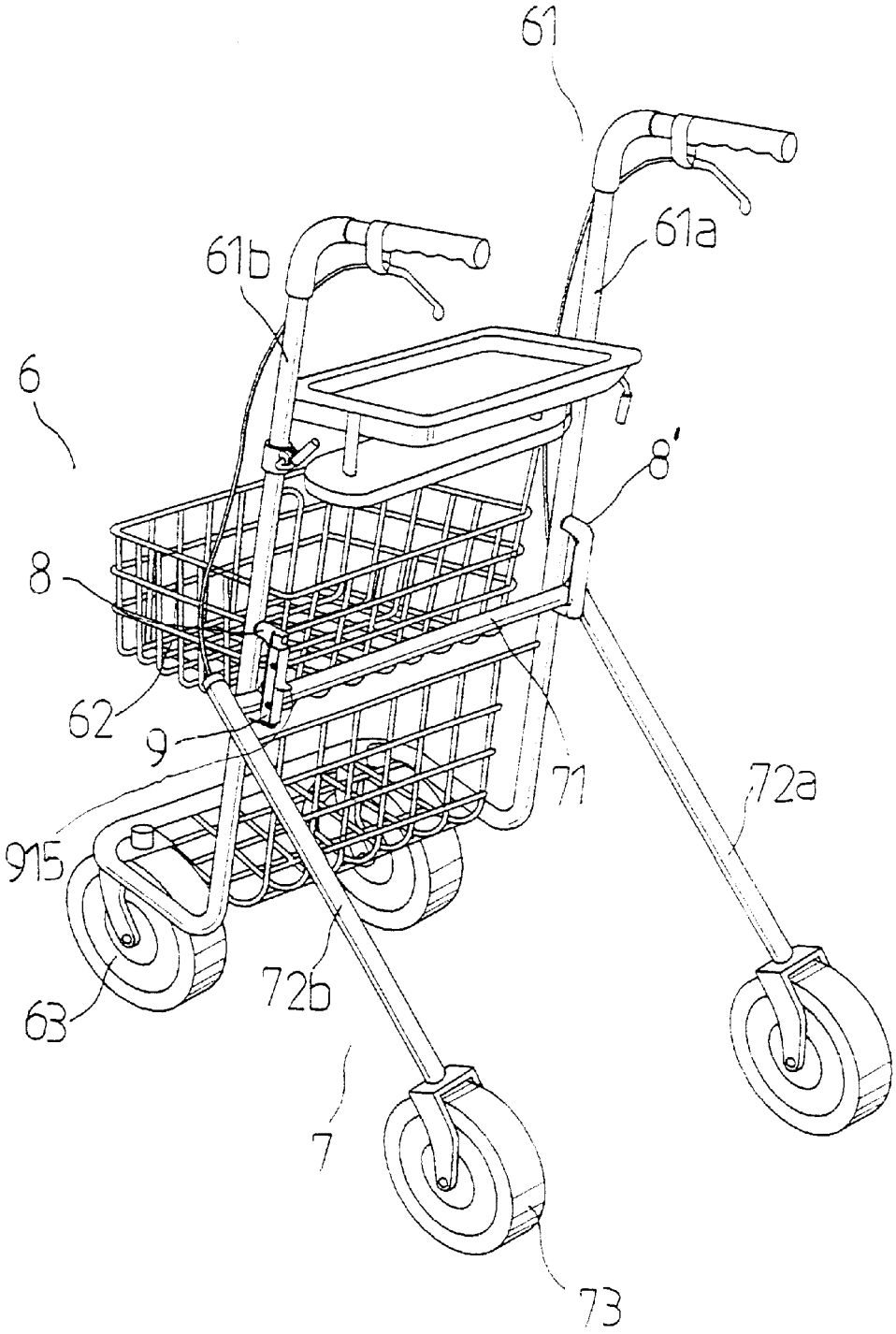
FIG. 3 is a rear perspective view of a pushcart according to the present invention with two collapsible legs locked to an extended position.

Please refer to FIG. 3 in which a pushcart 6 according to the present invention is shown. The pushcart 6 mainly includes a front frame 61, a rear support 7, a locating brace 8', and a leg position control gear composed of a locking part 8 and a push part 9.

The front frame 61 includes parallelly extended first and second front braces 61*a*, 61*b*. Since the first and the second front braces 61*a*, 61*b* have a common bottom portion, the front frame 61 is actually an integral member. A plurality of holding means 62, such as baskets, nets, trays, etc., are connected to the front frame 61 between the first and the second front braces 61*a*, 61*b* for holding different articles. Two front wheels 63 are connected to a lower end of the front frame 61, and two upper ends of the first and the second front braces 61*a*, 61*b* form two handle grips at where a user may grip to manipulate the pushcart 6.

The rear support 7 includes a cross bar 71 and first and second legs 72*a*, 72*b* that are separately connected to two ends of the cross bar 71. The first and the second legs 72*a*, 72*b* are normally extended rearward and downward from the first and the second front braces 61*a*, 61*b*, respectively, of the front frame 61. Two rear wheels 73 are connected to lower ends of the first and the second legs 72*a*, 72*b*.

The locating brace 8' is fixedly connected to a rear side of, for example, the first front brace 61*a* at a position intended for the first leg 72*a* of the rear support 7 to connect to the first front brace 61*a*, and the leg position control gear is fixedly connected to a rear side of, for example, the second front brace 61*b* at a position intended for the second leg 72*b* of the rear support 7 to connect to the second front brace 61*b*, such that the cross bar 71 of the rear support 7 is extended between the locating brace 8' and the leg position control gear for the rear support 7 to pivotally turn about the cross bar 71 relative to the front frame 61 into an extended position for use, as shown in FIG. 3, or an collapsed position to closely attach to the front frame 61 for convenient storage.

The locating brace 8' is substantially in the shape of a square bracket intended for defining a space within which the cross bar 71 is allowed to move up and down. The leg position control gear provides a locking function to stop the rear support 7 from moving after the latter has been turned into the extended or the collapsed position. The locating brace 8' and the leg position control gear may be exchanged in their positions. It is also possible to replace the locating brace 8' with another set of leg position control gear. That is, one or two sets of leg position control gear may be mounted, depending on actual need. However, one set of leg position control gear is usually sufficient to achieve good effect of locking the rear support 7 to the extended or the collapsed position. In the illustrated FIG. 3, only one set of leg position control gear is mounted to the rear side of the second front brace 61*b*.

Figure 4:
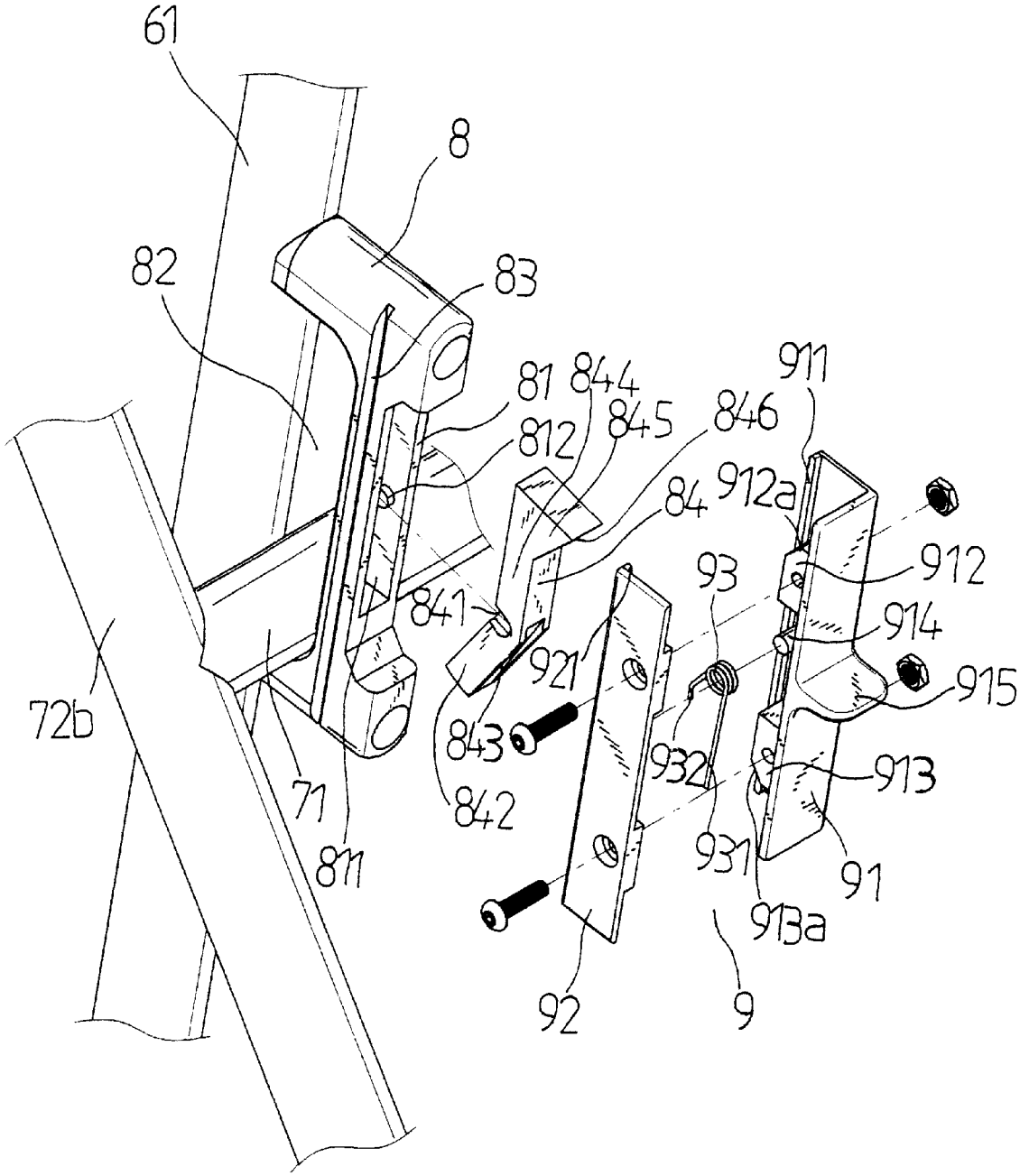
FIG. 4 is an enlarged and exploded perspective view of a leg position control gear for the pushcart of FIG. 3 to lock the collapsible legs of the pushcart to an extended position for use or a collapsed position for storage.

Please refer to FIG. 4. The locking part 8 of the leg position control gear is substantially in the form of a square bracket having a middle straight stem 81 and upper and lower ends fixedly connected to the rear side of the second front brace 61*b*, as mentioned above. The locking part in the shape of square bracket defines between the straight stem 81 and the second front brace 61*b* an open space 82 that is large enough for the cross bar 71 to extend therethrough and to move up and down therein. The straight stem 81 defines a long through hole 811 communicable with the open space 82 and has two vertical guide grooves 83 separately provided at two lateral sides thereof. Two pivot shafts 812 are provided in the long through hole 811 to face each other.

The locking part 8 of the leg position control gear also includes a lever 84 that is mounted in the long through hole 811 by engaging a recess 841 formed at a front side of the lever 84 with the two pivot shafts 812 in the long through hole 811, so that the lever 84 is pivotally turnable about the pivot shafts 812 in the long through hole 811 relative to the straight stem 81. The lever 84 includes a downward and forward extended lower arm 842 below the recess 841 and an upright upper arm 844 above the recess 841. The lower arm 842 is provided a rear side opposite to the recess 841 with a guide channel 843 and the upper arm 844 is provided at an upper free end with a rearward projected horn block 845 having a lower bevel surface 846.

The push part 9 of the leg position control gear includes an L-shaped main frame 91 and a side plate 92 that is screwed to an open side of the main frame 91 to together with the latter form a vertical U-shaped cover. Ribs 911 and 921 are provided at front edges of the main frame 91 and the side plate 92, respectively, to project toward each other. The U-shaped cover of the push part 9 is mounted to a rear side of the straight stem 81 of the locking part 8 with the two ribs 911, 921 separately engaged into the two vertical guide grooves 83 at two lateral sides of the straight stem 81, so that the push part 9 is slidable along the vertical guide grooves 83.

The main frame 91 has two substantially trapezoidal push blocks 912, 913 separately mounted to an upper and a lower portion thereof to limit the push part 9 to slide up and down only within a distance corresponding to the long through hole 811. The upper and the lower push blocks 912, 913 are provided at upper front end and lower front end, respectively, with bevel surfaces 912*a*, 913*a*. A pin 914 is transversely extended from a wall of the L-shaped main frame 91 to locate between the upper and the lower push blocks 912, 913 for an elastic element 93 to mount thereto.

Figure 5:
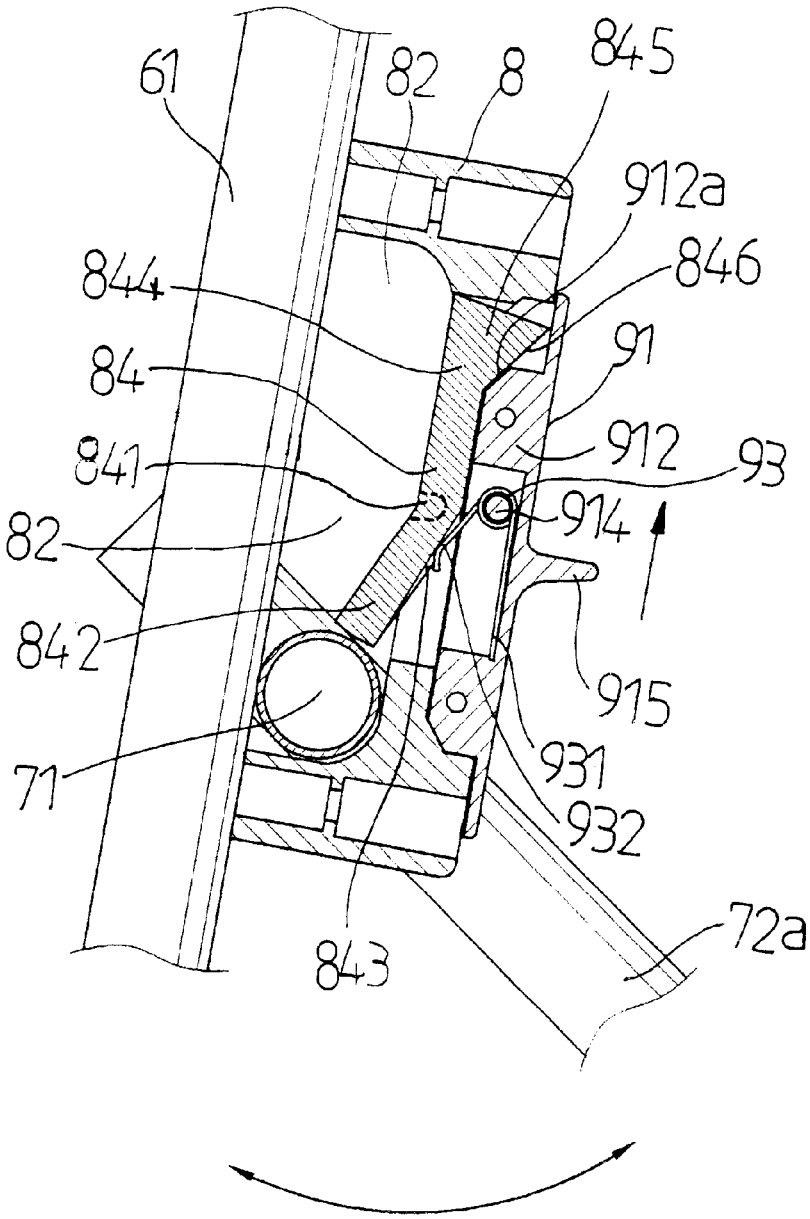
FIG. 5 shows the status of the leg position control gear when the legs of the pushcart of FIG. 3 are locked to the extended position.
Figure 6:
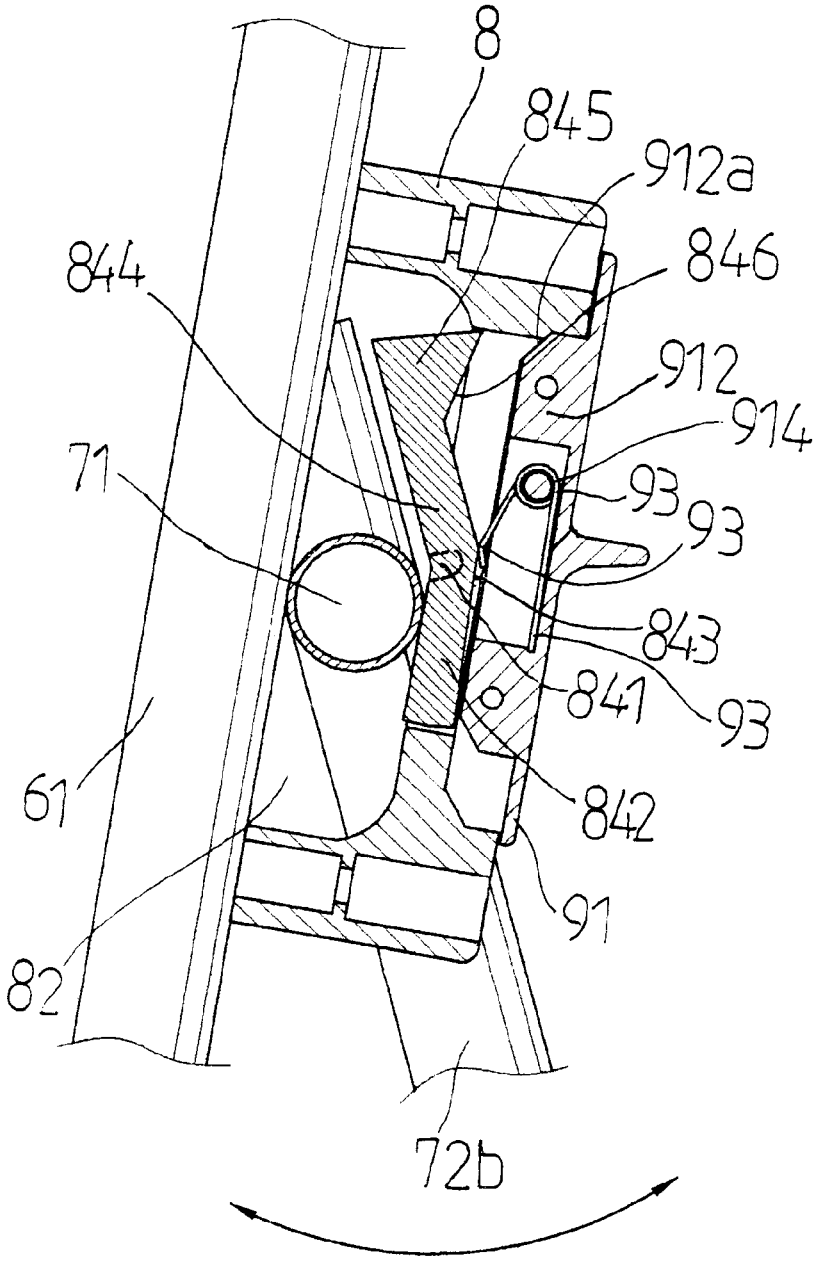
FIG. 6 shows the status of the leg position control gear when the legs of the pushcart of FIG. 3 are moved halfway to the collapsed position.
Figure 7:
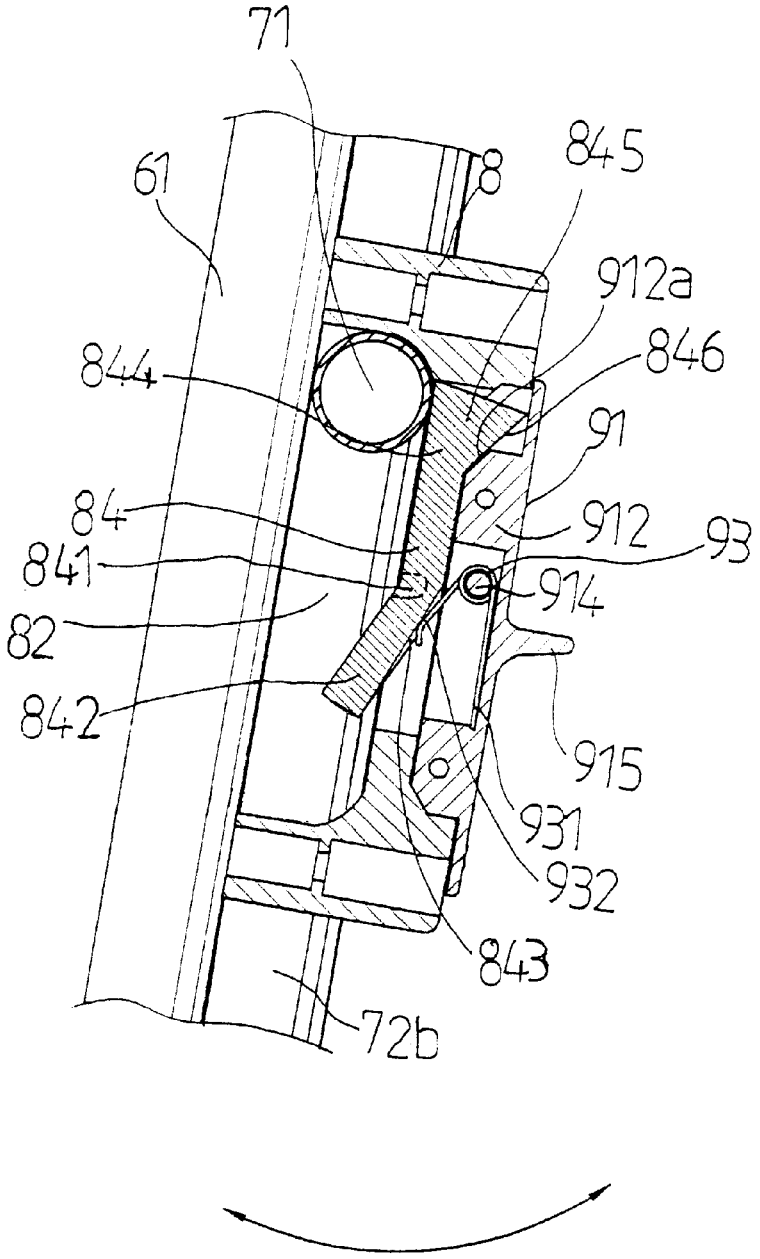
FIG. 7 shows the status of the leg position control gear when the legs of the pushcart of FIG. 3 are locked to the collapsed position.

The elastic element 93 includes a first arm 931 pressed against a rear inner surface of the main frame 91, and a second arm 932 pressed against the guide channel 843 at the rear side of the lower arm 842 of the lever 84 to normally push the lower arm 842 of the lever 84 to a forward locking position. The main frame 91 is provided at a rear outer surface with a lug 915 for a user to conveniently apply an upward force at the lug 915 and thereby move the push part 9 upward. FIGS. 5 to 7 illustrate operations of the leg position control gear.

Please first refer to FIG. 5. The rear support 7 of the pushcart 6 is in the extended position relative to the front frame 61. At this point, the cross bar 71 is located in the open space 82 at a lower end thereof, and the second arm 932 of the elastic element 93 on the pin 914 is pressed against the guide channel 843 of the lower arm 842 of the lever 84. Due to a spring force of the elastic element 93, the second arm 932 pushes the lower arm 842 of the lever 84 in a direction of the guide channel 843, forcing the lever 84 to pivotally turn about the recess 841 and the pivot shafts 812 and causing the lower arm 842 to extend from the long through hole 811 into the open space 82 and firmly push against the cross bar 71 to lock the latter to the lower end of the open space 82.

When a user intends to collapse the rear support 7 of the pushcart 6, he or she needs only to upward push the lug 915 with a finger, as indicated by the arrow in FIG. 5, and the whole push part 9 is moved upward as shown in FIG. 6. When the push part 9 is moving upward, the upper front bevel surface 912*a* of the upper push block 912 slides along the lower bevel surface 846 of the horn block 845 of the upper arm 844 and pushes the lever 84 to forward turn about the recess 841 and the pivot shafts 812, bringing the lower arm 842 to move backward into the long through hole 811 in the straight stem 81 and release the cross bar 71. At this point, the cross bar 71 is allowed to move upward in the open space 82.

When the cross bar 71 is moved upward in the open space 82 to an upper end thereof, as shown in FIG. 7, the first and the second legs 72*a*, 72*b* are also moved to a position in parallel with the first and the second front braces 61*a*, 61*b*, respectively, bringing the whole rear support 7 to the collapsed position for conveniently storing the pushcart 6.

To extend the collapsed rear support 7 again, the user needs only to push the cross bar 71 downward in the open space 82, so that the first and the second legs 72*a*, 72*b* are moved backward from the first and the second front braces 61*a*, 61*b* until the whole rear support 7 reaches the position shown in FIG. 5. At this point, the spring force of the elastic element 93 pushes the lower arm 842 of the lever 84 forward into the open space 82 to interfere with the cross bar 71 and lock the same to the lower end of the open space 82.

Please note, the rear support 7 could be accurately and quickly extended from the collapsed position again and be locked to that position by the lever 84 without the need of moving the push part 9. And, to collapse the rear support 7, the user needs only to lightly push the lug 915 of the push part 9 upward to disengage the lower arm 842 of the lever 84 from the cross bar 71. Therefore, the leg position control gear of the present invention enables the pushcart 6 to be conveniently extended or collapsed.

The whole leg position control gear is enclosed in the U-shaped cover formed from the main frame 91 and the side plate 92. There is not any clearance or gap on the leg position control gear to dangerously pinch and injure the user during the course of operating the gear. And, the cross bar 71 is released from the lower arm 842 of the lever 84 by upward pushing the lug 915 of the push part 9, and the lug 915 is not easily moved upward due to an unexpected collision that usually applies a horizontal force to the lug 915. Therefore, the pushcart 6 is not easily subjected to unexpected collapse and is safer for use.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A pushcart, comprising:

a front frame including two parallelly extended front braces having an integrally connected common bottom portion, said two front braces being provided at upper ends with handle grips and at said common bottom portion with wheels, and having a plurality of holding means connected therebetween for holding different articles;

a rear support including a cross bar transversely located behind said two front braces, and two legs parallelly extended from two ends of said cross bar wish two wheels connected to lower ends of said legs; and said rear support being pivotally turnable about said cross bar relative to said front frame between an extended position and a collapsed position;

a locating brace being fixedly mounted on a rear side of one of said two front braces to support one end of said cross bar of said rear support, such that said end of said cross bar is up and down movable within a space defined between said locating brace and said front brace on which said locating brace is mounted; and a leg position control gear being mounted on a rear side of another one of said two front braces corresponding to said locating brace for supporting the other end of said cross bar, said leg position control gear including at least a locking part, a push part, a lever, and an elastic element;

said locking part being fixedly mounted, on the rear side of said another front brace and including at least a straight stem to define between said straight stem and said another front brace an open space large enough for said cross bar to move up and down within said open space; said straight stem being provided with a long through hole for said lever to pivotally mount therein, and said long through hole being communicable with said open space;

said push part being covered onto a rear side of said locking part and being up and down movable relative to said locking part; and said elastic element being mounted to an inner side of said push part to normally push a lower end of said lever into said open space;

whereby when said rear support is pivotally turned to said extended position with said cross bar located at a lower end of said open space, said lower end of said lever is pushed by said elastic element to firmly press against said cross bar and lock said two legs of said rear support to said extended position, and when said push part is upward pushed, said lever is pivotally turned by said push part to release said cross bar from said lower end of said lever, allowing said cross bar to move upward in said open space and said rear support to move toward said front frame into said collapsed position.

2. The pushcart as claimed in claim 1, wherein said locking part of said leg position control gear is substantially in the form of a square bracket with said straight stem forming a middle part thereof, and two ends of said locking part being fixedly connected to the rear side of said another front brace to define said open space between said another front brace and said straight stem.

3. The pushcart as claimed in claim 1, wherein said push part of said leg position control gear includes an L-shaped main frame and a side plate that together form a vertical U-shaped cover for closing onto the rear side of said locking part.

4. The pushcart as claimed in claim 1, wherein said locking part of said leg position control gear is provided at two lateral outer sides with two vertically extended guide grooves for engaging with ribs provided on said push part, so that said push part is up and down movable relative to said locking part only along said two guide grooves.

5. The pushcart as claimed in claim 3, wherein said push part is provided at two inner front edges of said U-shaped cover with two ribs, and said locking part being provided at two lateral outer sides of said straight stem with two vertically extended guide grooves for engaging with said two ribs on said push part.

6. The pushcart as claimed in claim 4, wherein said ribs are provided at two inner front edges of said push part, and said two vertically extended guide grooves being provided at two lateral outer sides of said straight stem of said locking part.

7. The pushcart as claimed in claim 1, wherein said lever is pivotally mounted in said long through hole of said straight stem by turnably supporting said lever on pivot shafts provided in said long through hole.

8. The pushcart as claimed in claim 1, wherein said lever of said leg position control gear includes a forward and downward extended lower arm and an upright upper arm, said lower arm being provided at a rear side with a guide channel, with which said elastic element being in contact to push said lower arm of said lever forward into said open space, and said upper arm being provided at an upper free end with a rearward projected horn block having a lower bevel surface.

9. The pushcart as claimed in claim 8, wherein said elastic element of said leg position control gear includes a first arm pressing against an inner wall surface of said push part, and a second arm pressing against said guide channel of said lower arm of said lever.

10. The pushcart as claimed in claim 3, wherein said main frame of said push part is provided at an inner side with two substantially trapezoidal push blocks separately connected to upper and lower portion of said main frame, such that said push part is limited by said push blocks to slide up and down only within a distance corresponding to said long through hole in said straight stem of said locking part.

11. The pushcart as claimed in claim 10, wherein said main frame of said push part is provided between said two push blocks with a transverse pin for said elastic element to mount thereto.

12. The pushcart as claimed in claim 1, wherein said push part is provided at a rear outer surface with a lug, and said push part being upward movable when an upward force is applied on said lug.

* * * * *